United States Patent [19]

Billard

[11] Patent Number: 4,463,679

[45] Date of Patent: Aug. 7, 1984

[54] HIGH POWER PYROTECHNIC FLARE

[75] Inventor: Alain Billard, Muret, France

[73] Assignee: Etienne Lacroix Tous Artifices SA, Muret, France

[21] Appl. No.: 370,015

[22] Filed: Apr. 19, 1982

[30] Foreign Application Priority Data

Apr. 23, 1981 [FR] France ..... 81 08106

[51] Int. Cl.[3] ..... F42B 4/00; F42B 4/26

[52] U.S. Cl. ..... 102/336; 102/202.13; 102/277.1; 102/361

[58] Field of Search ..... 102/334, 335, 336, 361, 102/202.13, 277, 277.1, 277.2, 289, 290

[56] References Cited

U.S. PATENT DOCUMENTS

| | | | |
|---|---|---|---|
| 3,494,283 | 2/1970 | Cronk | 102/336 |
| 3,670,657 | 6/1972 | Evans | 102/336 |
| 3,970,003 | 7/1976 | Hayward et al. | 102/336 |

*Primary Examiner*—Charles T. Jordan
*Assistant Examiner*—Ted L. Parr
*Attorney, Agent, or Firm*—Alan H. MacPherson; Thomas S. MacDonald

[57] ABSTRACT

The present invention relates to pyrotechnic flares. A hollow support structure (1) receives a first pyrotechnic composition (2) with a delay action internally and axially, whereas it receives a second pyrotechnic composition (4) which is slower than the first, in holes (101 to 151), arranged radially and of decreasing length. An initiator (3) initiates the composition (2) on the side where the radial through-holes are longest. Located outside is an illuminating composition (5), which may thus be illuminated virtually at the same time over the entire length of the product.

Application in particular as an optical or infra-red counter-measure.

12 Claims, 3 Drawing Figures

HIGH POWER PYROTECHNIC FLARE

The invention relates to pyrotechnic flares.

Outside their conventional applications for illuminating a dark area, it is also possible to envisage the use of pyrotechnic flares for defence, as a counter-measure. It is then literally a question of blinding an assailant. A problem immediately arises: namely obtaining an instantaneous high power of illumination.

The present invention provides a simple and effective solution to this problem.

The pyrotechnic flare proposed comprises in combination:

a support structure of general hollow tubular shape;

inside this support structure a first pyrotechnic composition with a delay action;

at one of the ends of the support structure at least one initiator for the first pyrotechnic composition having a delay action;

the support structure comprising from its end adjacent the initiator, radial through-holes distributed over its length, the length of these holes decreasing according to a substantially linear function of their distance from the initiator, in the through-holes, a second pyrotechnic composition having a delay action;

the ratio of the decrease in the length of the holes to the distance from the initiator and the ratio of the linear delays of the two pyrotechnic compositions having a delay action being chosen in order that the flame emerges virtually at the same time from the through-holes and an illuminating pyrotechnic composition encasing the support structure.

Preferably, the second pyrotechnic composition having a delay action has a linear speed of propagation of flame approximately ten to twenty times less than that of the first pyrotechnic composition having a delay action.

In one particular embodiment, the through-holes are provided in ribs integral with the hollow tubular core of the support structure.

Advantageously, there are four through-holes, spaced apart by an angle of 90°, in each cross-section of the support structure.

According to another preferred feature of the invention, the inner cross-section of the support structure widens out progressively from the initiator.

In practice, the thickness of the illuminating composition packing is substantially constant along the support structure.

It is desirable, but not imperative that the distance between two adjacent through-holes along the support structure is of the same order as the radial thickness of the illuminating composition in the vicinity of a through-hole.

According to another preferred feature of the invention, the illuminating composition packing is established substantially isometrically from each through-hole.

Advantageously, the illuminating composition is enclosed in a flexible envelope, such as a bag.

The pyrotechnic flare of the invention may be released, dropped and/or propelled, for example from an aircraft. It will thus serve to blind and/or damage the optical detection systems of an assailant.

The illuminating composition operates in the infrared range and/or in the visible range, preferably in both.

Further features and advantages of the invention will become apparent on reading the ensuing detailed description, made with reference to the accompanying drawings, given in order to illustrate a preferred embodiment of the invention as a non-limiting example and in which.

Figure 1:
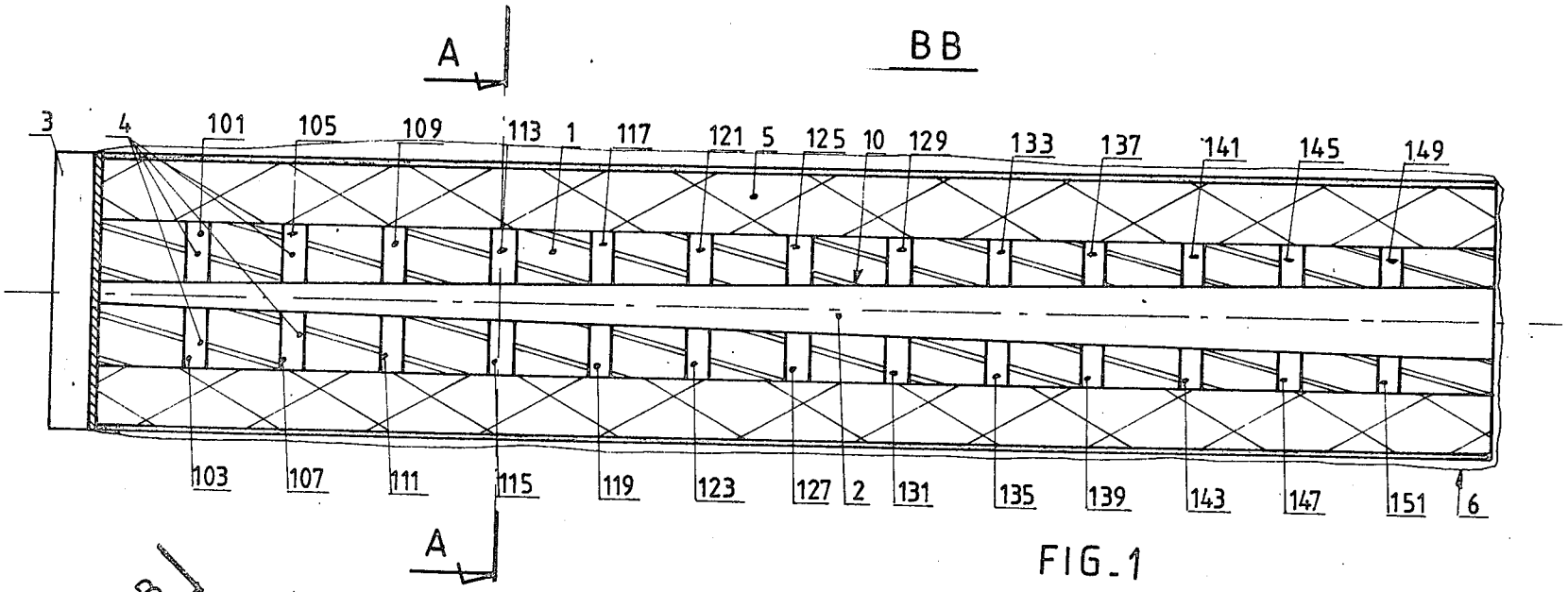
FIG. 1 is a view in axial section of a pyrotechnic flare according to the present invention.

In FIG. 1, the reference numeral 1 designates a support structure of general hollow tubular shape and which is advantageously made from rigid plastics material. Located at one of the ends of the support structure is at least one initiator 3. The latter may have numerous different embodiments and is not illustrated in detail. Located in the inner tubular core 10 of the support structure 1 is a first pyrotechnic composition having a delay action, designated generally by the reference numeral 2. This composition 2 having a delay action comes into contact with the initiator 3, in order to be able to be ignited by the latter.

Figure 2:
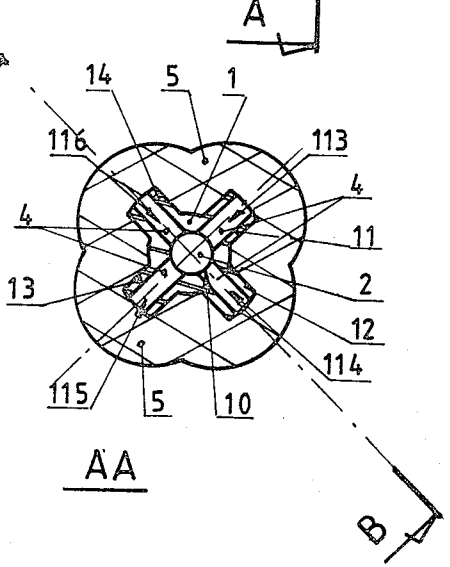
FIG. 2 is a view in cross-section of the flare of FIG. 1, on section line A—A.

As illustrated in FIG. 1, the inner tubular core 10 of the support structure preferably has a cross-section increasing progressively as one moves away from the initiator 3. In this case, this tubular core 10 is in the form of a very elongated truncated cone. As shown in FIG. 2, the support structure 1 is also provided with four right-angled ribs, designated by the references 11 to 14. These ribs extend towards the outside. Radial through-holes are provided from place to place on the support structure, in the ribs of the latter. FIG. 2 shows four of the holes, namely the hole 113 in the rib 11, the hole 114 in the rib 12, the hole 115 in the rib 13 and finally the hole 116 in the rib 14. If we now refer to FIG. 1, where only the ribs 11 and 13 are shown in section, it can be seen that the through holes are staggered in a uniformly distributed manner along the entire length of the support structure, beginning with the hole 101, the hole 102 which is not shown, the hole 103, the hole 104 which is not shown and so on for the following cross-section up to the hole 151, the very last hole 152 not being shown.

Figure 3:
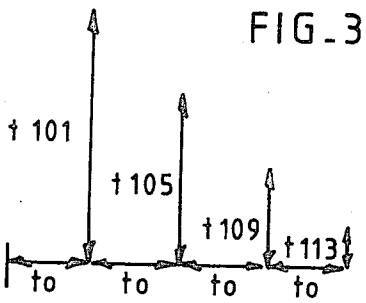
FIG. 3 is a diagram intended to illustrate the method of operation of the pyrotechnic flare according to the invention.

According to an important feature of the invention, the length of these through holes 101 to 151, decreases according to a substantially linear function of their axial distance from the initiator 3. A second pyrotechnic composition having a delay action designated by the general reference numeral 4 is located in the through holes. In practice, the composition 2 having a delay action is slow, whereas the composition 4 having a delay action is fast. It is thus possible to establish a first ratio between the decrease in the length of the through holes such as 101 etc., and their distance from the initiator 3. It is possible to establish a ratio of the linear delays provided by the two pyrotechnic compositions 2 and 4 having a delay action, taking into account both their own characteristics and their geometric arrangement inside the flare. These two delays are chosen in order that the flame emerges from the through-holes virtually at the same time. FIG. 3 illustrates this diagrammatically, with reference to the holes 101 to 113. The distances between these holes, taken along the axis of the support structure 1, are virtually equal and it is thus possible to admit that the delay of the pyrotechnic composition 2 is establish at $t_0$ from one hole to the other. The hole 101 will thus receive the flame with a delay $t_0$ with respect to the excitation of the initiator 3. The flame wll consequently emerge from this hole 101 at the end of a delay $t_{101}$, linked with the nature of the second pyrotechnic composition having a delay action, as well as with the length of this hole 101. The flame will thus emerge from the hole 101 at the end of a time equal to $t_0+t_{101}$. As regards the hole 105, the flame will arrive by way of the composition 2 at the end of a time $2.t_0$ and the hole itself will take a time $t_{105}$ in order to spread the flame as far as its outlet. Similarly, for the hole 109, one will have an overall time $3.t_0+t_{109}$; finally, for the hole 113, the flame will emerge at the end of a time $4.t_0+t_{113}$.

It is thus sufficient to adjust the different values in order that the following relationship is satisfied:

$$t_0+t_{101}=2.t_0+t_{105}=3.t_0+t_{109}=4.t_0+t_{113}$$

The flame which thus emerges virtually at the same time from all the through holes will ignite an illuminating pyrotechnic composition 5 enclosing the support structure. The latter will be ignited at the same time over the entire length of the flare and one thus obtains a considerable instantaneous power.

Preferably, the second pyrotechnic composition 4 having a delay action has a linear speed of propagation of flame approximately ten to twenty times greater than that of the first pyrotechnic composition 2 having a delay action. In practice, this allows a relatively simple construction, taking into account tolerances with regard to the delays of the compositions and the dimensions of the holes and this is for a pyrotechnic flare of elongated structure.

Another feature of the invention contributes to the instantaneous high power of the illumination: it is provided that the thickness of the illuminating composition packing is substantially constant along the support structure 1 and that on the other hand the illuminating composition packings 5 are established substantially isometrically from each through-hole. In FIG. 2, this is apparent by the fact that the composition 5 is defined by four arcs of circles, which are each centered substantially at the outlet point of the nearest through-hole. Naturally, instead of arcs of circles, one may provide a roughly equivalent structure, for example a square cross-section, whereof the vertices would be aligned with the axes of the through-holes of FIG. 2.

For the same reason, it is desirable that the distance between two adjacent through-holes, such as 101 and 105, taken along the support structure, is of the same order as the radial thickness of the illuminating composition 5 in the vicinity of a through-hole. The illuminating composition 5 is thus fired simultaneously at sufficient locations in order that the ignition of the latter is virtually instantaneous over its entire length.

Finally, according to another feature of the invention, it is useful that the entire illuminating composition 5 is enclosed in a flexible envelope, such as a bag 6, which contributes to satisfactory propagation of the flame in the illuminating composition, if this is still necessary.

For the pyrotechnic composition 2 which will contribute to the axial propagation of the flame in the support structure 1, one could adopt a speed of propagation of approximately two thousand meters per second, this speed being able to reach up to eight thousand meters per second. As mentioned previously, the speed of propagation of the other composition will be ten to twenty times less than that of the first, preferably fourteen to fifteen times less than the latter. The ignition of the illuminating pyrotechnic composition may thus be obtained at the same time over the entire flare and this is with an accuracy of the order of $10\mu$ seconds. It is thus possible to obtain a power of 100 optical megawatts, both in the infra-red range and in the visible light range. Such a power is able to blind optical or infra-red detectors of an assailant appliance temporarily if not permanently.

Naturally, the present invention is not limited to the embodiment described and extends to all variations within its scope.

I claim:

1. Pyrotechnic flare, characterised in that it comprises, in combination:

a support structure forming a core of hollow tubular shape;

inside this support structure, a first pyrotechnic composition having a delay action;

at one of the ends of the support structure, at least one initiator for the first pyrotechnic composition;

the support structure comprising, from its end adjacent the initiator, radial through-holes distributed over the length of the support structure, the length of these holes decreasing according to a substantially linear function of their distance from the initiator;

in the through-holes, a second pyrotechnic composition having a delay action;

the ratio of the decrease in the length of the holes to the distance from the initiator and the ratio of the linear delay of the two pyrotechnic compositions having delay actions being chosen in order that upon combustion a flame emerges virtually at the same time from the through-holes; and an illuminating pyrotechnic composition enclosing the support structure.

2. Flare according to claim 1, characterised by the fact that the second pyrotechnic composition having a delay action has a linear speed of propagation of flame approximately ten to twenty times less than that of the first pyrotechnic composition having a delay action.

3. Flare according to claim 1 or 2, characterised by the fact that the through-holes are provided in ribs integral with the hollow tubular core of the support structure.

4. Flare according to claim 3, characterised by the fact that there are four through-holes, separated by an angle of 90°, in each cross-section of the support structure.

5. Flare according to claim 4, characterised by the fact that the inner diameter of the support structure core widens out progressively from the initiator.

6. Flare according to claim 5, characterised by the fact that the thickness of the illuminating composition is substantially constant along the support structure.

7. Flare according to claim 6, characterised by the fact that the distance between two adjacent through-holes along the support structure is of the same order as the radial thickness of the illuminating composition enclosing a through-hole.

8. Flare according to claim 7, characterised by the fact that the illuminating composition is arranged isometrically from each through-hole.

9. Flare according to claim 8, characterised by the fact that the entire illuminating composition is enclosed in a flexible envelope such as a bag.

10. A pyrotechnic flare comprising:

a hollow core tubular longitudinally-extending support structure;

a first pyrotechnic delay-action composition extending longitudinally within the hollow core of said support structure;

an initiator juxtaposed to said support structure to ignite said first pyrotechnic composition;

said structure support having a spaced series of through-holes extending longitudinally along and outwardly from said hollow core;

a second pyrotechnic delay-action composition extending in said through-holes; and an illuminating pyrotechnic composition enclosing the longitudinal circumferance of said support structure radially outward from said through-holes;

whereby said initiator ignites said first pyrotechnic composition which in turn ignites said second pyrotechnic composition which in turn ignites said illuminating pyrotechnic composition.

11. The invention of claim 10 wherein the first and second delay compositions burn at a rate and have a burning path of a length that said illuminating pyrotechnic composition is ignited along its longitudinal length at the same time.

12. The invention of claim 10 in which said initiator is at one end of said structure support, said first pyrotechnic composition is of increasing diameter as it extends in said core away from said initiator and said through-holes are of decreasing length as linear function of their distance from the initiator.

* * * * *

UNITED STATES PATENT AND TRADEMARK OFFICE

CERTIFICATE OF CORRECTION

PATENT NO. : 4,463,679

DATED : August 7, 1984

INVENTOR(S) : Alain Billard

It is certified that error appears in the above—identified patent and that said Letters Patent is hereby corrected as shown below:

In Column 4, line 35 replace "delay" with --delays--.

Signed and Sealed this

*Seventh* Day of *May 1985*

[SEAL]

*Attest:*

DONALD J. QUIGG

*Attesting Officer* *Acting Commissioner of Patents and Trademarks*